United States Patent [19]

Watanuki et al.

[11] Patent Number: 4,913,477

[45] Date of Patent: Apr. 3, 1990

[54] WATERPROOF DOOR LOCK FOR AUTOMOTIVE VEHICLE

[75] Inventors: Yoshio Watanuki, Ebina; Haruo Mochida, Kanagawa, both of Japan

[73] Assignee: Nissan Motor Co., Ltd., Yokohama, Japan

[21] Appl. No.: 219,506

[22] Filed: Jul. 15, 1988

[30] Foreign Application Priority Data

Jul. 17, 1987 [JP] Japan ..... 62-178699
Jul. 17, 1987 [JP] Japan ..... 62-109595

[51] Int. Cl.[4] ..... E05C 3/26

[52] U.S. Cl. ..... 292/216; 292/337; 292/DIG. 38; 292/DIG. 53

[58] Field of Search ..... 292/201, 216, 280, 337, 292/DIG. 38, DIG. 53

[56] References Cited

U.S. PATENT DOCUMENTS 4,735,447 4/1988 Kleefeldt ..... 292/216
4,756,563 7/1988 Garwood et al. ..... 292/337 X
4,775,176 10/1988 Ikeda ..... 292/216

FOREIGN PATENT DOCUMENTS 46-15882 4/1971 Japan .
50-26518 3/1975 Japan .
56-52562 5/1981 Japan .

*Primary Examiner*—Richard E. Moore
*Attorney, Agent, or Firm*—Foley & Lardner, Schwartz, Jeffery, Schwaab, Mack, Blumenthal & Evans

[57] ABSTRACT

To protect a door lock mechanism for an automotive vehicle from water or freezing, the door lock mechanism is arranged between a base plate member and a resin protective cover; the upper end portions of the base plate are covered by peripheral walls extending from the walls of the protective cover; the control levers are led out toward the outside through lead-out openings formed horizontally outward between the end surface of the base plate member and the lower surface of the peripheral wall of the protective cover; and some U-shaped control levers are led out through the lead-out openings so as to take a long way around the side edges of the peripheral walls of the protective cover at the lead-out openings.

1 Claim, 4 Drawing Sheets

WATERPROOF DOOR LOCK FOR AUTOMOTIVE VEHICLE

BACKGROUND OF THE INVENTION

1. Field of the Invention

Thee present invention relates to a waterproof door lock for an automotive vehicle, and more specifically to a waterproof structure of a door lock mechanism which can effectively protect the lock/unlock mechanism from water for prevention thereof from rust and freezing.

2. Description of the Prior Art

As is well known, a door lock for an automotive vehicle is assembled in an automotive vehicle door to lock/unlock the vehicle door. An example of the prior-art door locks is disclosed in Japanese Published Examined (Kokoku) Application No. 46-15882, for instance, which is hereby incorporated by reference.

Usually, the door lock mechanism is assembled on a base plate formed by a press machine, and a control mechanism for controllably actuating a latch locking-/unlocking pawl is pivotally mounted on the surface of the base plate. This control mechanism is composed of a plurality of externally extending levers (i.e. an outside handle lever, an inside handle lever, a lock handle lever, etc.) and some other lock/unlock levers interconnecting these handle levers, which are all pivotally supported by many support pins fixed to the base plate. That is, a number of pivotal members extending outside are incorporated as control mechanism in the door lock.

On the other hand, since rain water or washing water flows into the door lock easily along the inside surface of the door or door window glass, there exists a problem that the mechanical elements arranged within the door lock are rusted by water and therefore will not operate reliably. In addition, in winter or in cold districts, since water flowing into the door lock is frozen, there exists another problem that the door lock will not be actuated and therefore door locking operation is disabled.

To overcome the above-mentioned problem, it may be considered to completely cover the whole control mechanism by a waterproof protective cover. In practice, however, since the control mechanism includes a plurality of levers (an outside handle lever, an inside handle lever, a lock knob lever, etc.) extending outside, there exists a problem that water easily enters the door lock mechanism through openings through which the levers are led out outside and therefore it is impossible to solve the above-mentioned drawbacks (rust or freezing) involved in the prior-art door lock for an automotive vehicle.

SUMMARY OF THE INVENTION

Therefore, with these problems in mind, it is the primary object of the present invention to provide a waterproof door lock for an automotive vehicle, which can effectively protect the door lock from water or water drops and therefore from rust or freezing.

To achieve the above mentioned objective, a waterproof door lock attached to a door to control a door latch locking/unlocking pawl for an automotive vehicle, according to the present invention comprises: (a) a base plate member fixed to inside the door; (b) a protective cover, attached to said base plate member, having at least one peripheral wall extending from a wall of said protective cover 9 to cover at least one upper end portion of said base plate member; and (c) a door lock mechanism, arranged between said base plate member and said protective cover, for selectively actuating the door latch locking/unlocking pawl.

Further, the door lock mechanism comprises a plurality of control levers each led out outside through a lead-out opening formed horizontally outward between an end side surface of said base plate member and a lower surface of the peripheral wall of said protective cover.

Further, the control lever is formed with a U-shaped bent portion led out through the lead-out opening by taking a long way around the end side surface of the peripheral wall of said protective cover.

DETAILED DESCRIPTION OF THE PREFERRED EMBODIMENTS

Figure 1:
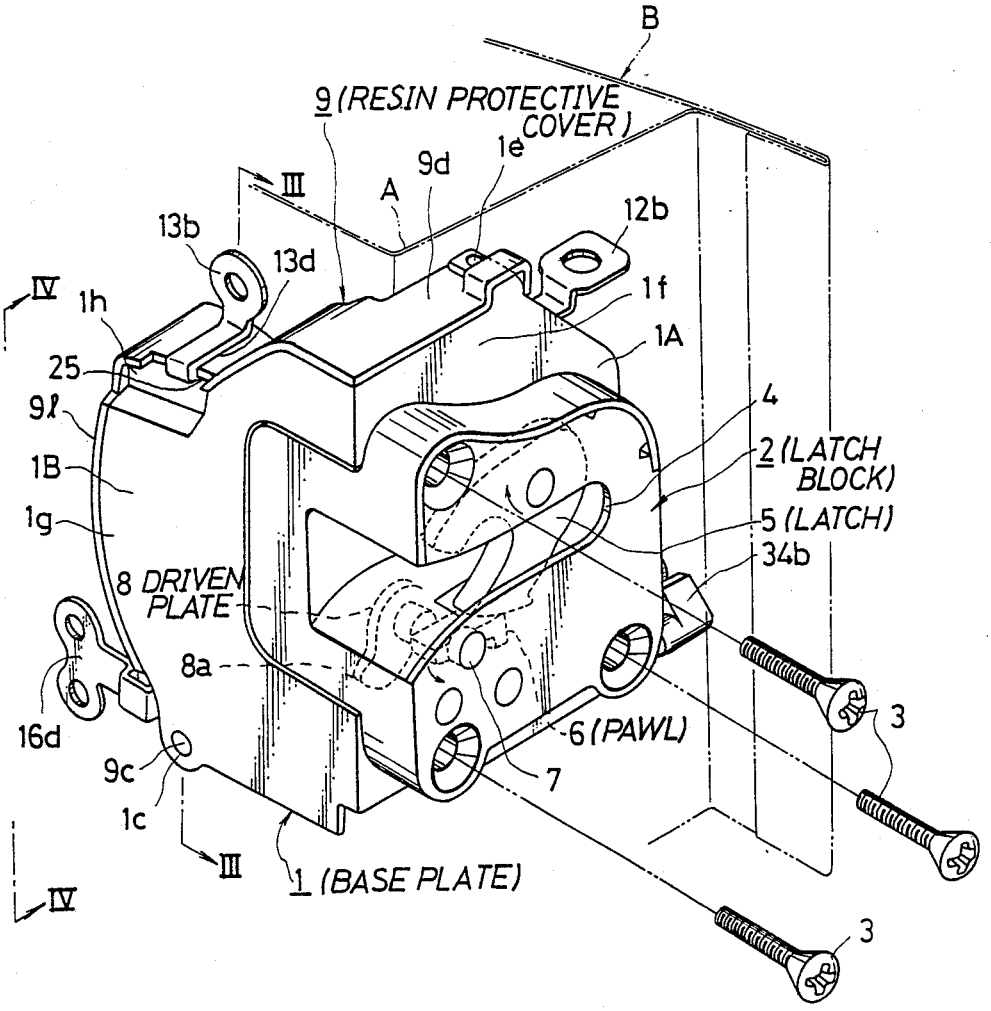
FIG. 1 is a perspective view showing an embodiment of a waterproof door lock for an automotive vehicle according to the present invention.

FIGS. 1 to 4 show an embodiment of the waterproof door lock for an automotive vehicle. The door lock shown in FIG. 1 is mounted on a righthand door inner panel A of a vehicle door B. The door lock roughly comprises a metallic base plate member 1 bent at right angles so as to form an end wall portion 1A and a side wall portion 1B; a protective cover 9 made of a relatively rigid resin so as to cover the base plate member 1; and a plurality of control levers extending outside in various directions. The feature of the present invention is to form and assemble these elements into a reliable waterproof structure.

A latch block 2 formed so as to correspond to an opening portion 1*a* (shown in FIG. 2) objective brought into contact with an end wall 1A of the base plate 1 from the door end side and firmly fixed to the end wall 1A by fastening three screws 3 to three threaded holes 1*b* (shown in FIG. 2) formed in the end wall 1A of the base plate 1.

The well-known latch block 2 is formed with a striker groove 4 to which a striker (not shown) for fixing the door to a body is fitted. A fork-shaped latch 5 engageable with the striker coming into the upper side of the striker groove 4 is pivotally supported on the latch block 2. Latch 5 is urged clockwise in FIG. 1 by a spring (not shown). A latch pawl 6 is pivotably supported about a pawl shaft 7 below the striker groove 4 in order to selectively actuate the latch 5 to three positions, namely, unlatch, half latch and full latch. This pawl 6 is urged counterclockwise in FIG. 1 by a spring (not shown). An inner end of the pawl shaft 7 is fixed to a driven plate 8 on the side remote from the end wall 1A of the door inner panel A. As described later, this driven plate 8 is pivoted to different angular positions by a control mechanism (various control levers) assembled on an inside surface of a protective cover 9 in order to lock/unlock the vehicle door via the latch pawl 6 and the latch 5.

A waterproof resin protective cover 9 injection-molded by a relatively rigid resin is attached to the rear side (in FIG. 1) of the base plate 1. This protective cover 9 is composed of two, first and second, walls 9*a* and 9*b* (FIG. 2) angle at a right arranged with respect to each other. The first wall 9*a* is placed so as to oppose to the end wall portion 1A of the base plate 1 and the second wall 9*b* is placed so as to oppose to the side wall portion 1B of the base plate 1, with an appropriate space between them, respectively.

Further, the protective cover 9 is formed with a locating pin 9*c* provided at the lower portion of the second wall portion 9*b*. This locating pin 9*c* is fitted to a locating hole 1*c* formed at the lower portion of the side wall 1B of the base plate 1. Further, in the protective cover 9, a square fixing hole 10 (FIG. 2) is formed at the lower portion of the first wall 9*a* thereof and another square fixing hole 11 (FIG. 2) is formed at the upper peripheral wall 9*d* thereof (described later). On the other hand, in the base plate, a lug 1*d* is formed at the lower portion of the end wall 1A thereof and another lug 1*e* is formed at the upper portion of the end wall 1*a* thereof. Therefore, the protective cover 9 is fixed to the base plate by pressure fitting these two lugs 1*d* and 1*e* into these two square fixing holes 10 and 11 as shown by bent dot-dashed lines shown in FIG. 2.

Figure 3:
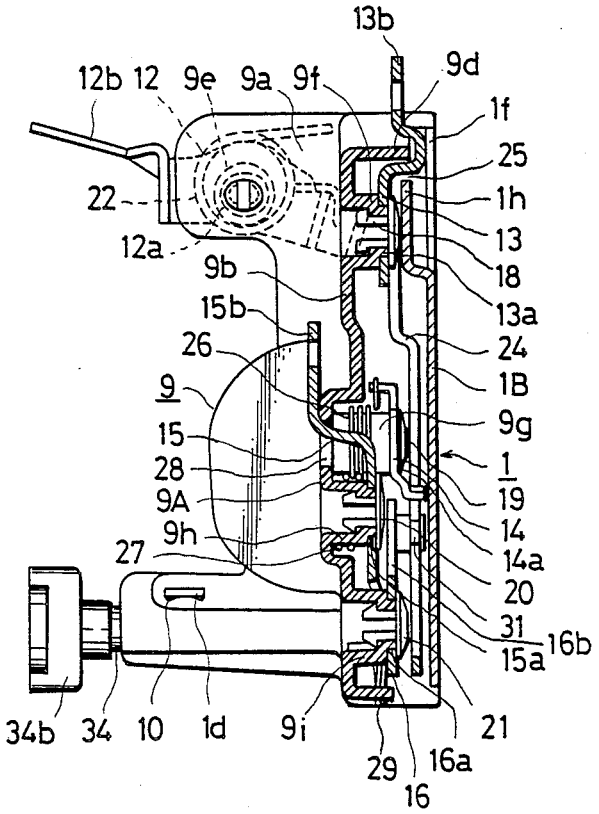
FIG. 3 is a cross-sectional view taken along a line III—III shown in FIG. 1.

To support various control levers, as depicted in FIG. 3, a cylindrical shaft portion 9*e* is formed in the second wall portion 9*b* of the protective cover 9 and four cylindrical shaft portions 9*e*, 9*f*, 9*g*, 9*h* and 9*i* are formed in the first wall portion 9*a* of the protective cover 9. On these five cylindrical shaft supporting portions 9*e*, 9*f*, 9*g*, 9*h* and 9*i*, five levers of an outside lever 12, a first inside lever 13, a cancel lever 14, a second inside lever 15 and a lock knob lever 16 are all pivotally mounted by fitting five pivot holes 12*a*, 13*a*, 14*a*, 15*a* and 16*a* to each stepped portion of these cylindrical shaft portions 9*e*, 9*f*, 9*g*, 9*h* and 9*i*. Further, to support each lever to each cylindrical shaft portion, each of resin clips 17, 18, 19, 20 and 21 is passed through each pivot hole 12*a*, 13*a*, 14*a*, 15*a* and 16*a* formed in the lever into each central hole of the cylindrical shaft portions 9*e*, 9*f*, 9*g*, 9*h* and 9*i*, respectively as best shown in FIG. 3.

With reference to FIGS. 1 and 2 again, the protective cover 9 is formed with an upper peripheral wall 9*d* extending perpendicular from the first wall portion 9*a* and a side peripheral wall 9*l* extending perpendicular from the second wall portion 9*b* thereof. These two peripheral walls 9*d* and 9*l* cover the upper portion 1*f* and the side portion 1*g* of the base plate 1, respectively in order to protect the mechanism housed in a space enclosed between the base plate 1 and the protective cover 9 from water. Further, in this embodiment, no peripheral wall is formed at the first wall portion 9*a* of the protective cover 9, because this portion is located near the door outer panel B thereby prohibiting a wall of rain flow. In addition, no peripheral wall is also formed at the lower side of the protective cover 9, because in case water enters the space between the base plate 1 and the protective cover 9, it is necessary to direct the water within the door lock in the downward direction.

As described above, in the waterproof door lock for an automotive vehicle according to the present invention, the door lock mechanism is arranged between the base plate and the protective cover, and the upper end portions of the base plate are covered by peripheral walls extending from the walls of the protective cover. Therefore, it is possible to effectively prevent water from coming into the door lock and therefore to prevent the control mechanism from being rusted or frozen.

The control mechanism composed of a plurality of control levers will be described in more detail hereinbelow.

Figure 2:
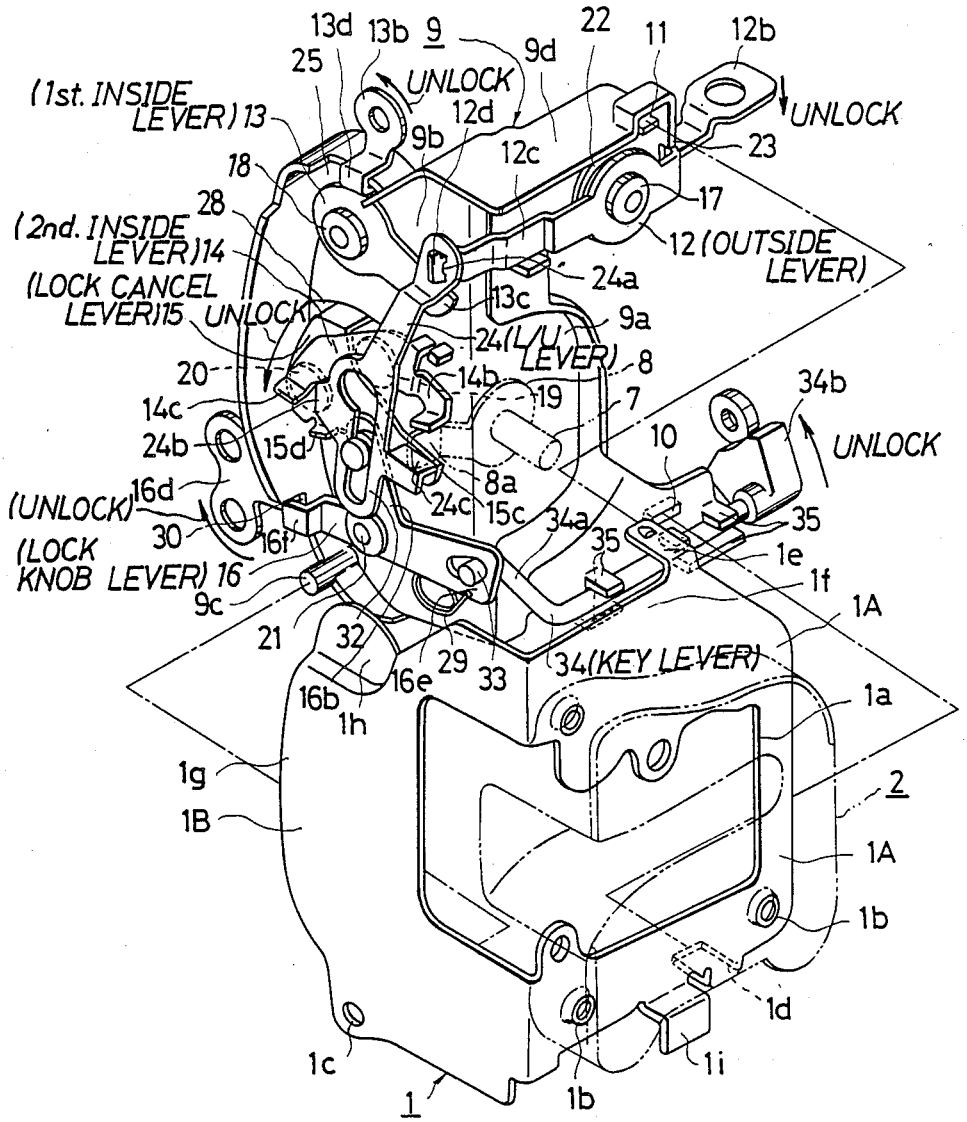
FIG. 2 is an exploded view of the door lock mechanism shown in FIG. 1.

(1) Outside lever 12:

Lever 12 is urged by a spring 22 in the counterclockwise direction as shown in FIG. 2. When this lever 12 is actuated clockwise, the door is unlocked as described later. Lever 2 is formed with an external linkage end portion 12*b* connected to an outside door handle (not shown), an actuation lever portion 12*c*, and a hook portion 12*d* engaged with an upper hole 24*a* of the lock/unlock lever 24 (described later). The external linkage end portion 12*b* of this lever 12 extends horizontally toward the outside through a lead-out opening 23 formed in the first peripheral wall 9*d* of the protective cover 9. Further, the external linkage end portion 12*b* is once bent perpendicular to the longitudinal direction of the lever 12 along the peripheral wall surface and then twisted again in the longitudinal direction of the lever 12, as depicted in FIG. 2.

(2) First inside lever 13:

When this lever 13 is actuated counterclockwise in FIG. 2, the door is unlocked as described later. This lever 13 is formed with an external linkage end portion 13*b* connected to an inside door handle (not shown), a U-shaped bent portion 13*d*, and an actuation end portion 13*c* located under the actuation lever portion 12*c* of the outside lever 12 to pivot this lever portion 12*c* upward when actuated. The external linkage end portion 13*b* of this lever 13 extends vertically toward the outside through a lead-out opening 25 formed between the upper side surface of a bent wall 1*h* of the side wall 1B of the base plate 1 and the lower surface of the upper peripheral wall 9*d* of the protective cover 9. Here, the U-shaped bent portion 13*d* of this lever 13 is bent so as to take a long way around the side edge of the upper peripheral wall 9*d* at the lead-out opening 25.

(3) Lock cancel lever 14:

This lever 14 cancels the door lock by returning the lock/unlock lever 24 to the unlock position (shown by phantom lines in FIG. 4) when the door is closed without actuating the outside handle (the outside lever 12 is kept pivoted counterclockwise in FIG. 2) after the inside lock knob is actuated to the lock position, as described later in more detail.

This lever 14 urged clockwise by a spring 26 (FIG. 3) is formed with a driven projection portion 14*b* located on an engaged projection portion 8*a* of the driven plate 8 pivotally supported on the latch block 2 and an actuation projection portion 14*c* located within a movement locus of an intermediate projection portion 24*b* of the lock/unlock lever 24.

(4) Second inside lever 15:

This lever urged clockwise by a spring 27 (FIG. 3) is an override lever used when the door lock is provided for a driver side door. Lever 15 is formed with an external linkage end portion 15*b* (FIG. 3) linked to an inside handle of the driver side door, an actuation end portion 15*c* (FIG. 2) located under the engage projection 8*a* of the driven plate 8 pivotally supported on the latch block 2, and an actuation claw portion 15*d* (FIG. 2) located within the movement locus of a side engagement surface 16c (FIG. 4) of the actuation arm 16b of a lock know lever 16 (described later).

The external linkage end portion 15b of this lever 15 extends horizontally toward the outside through a lead-out opening 28 formed in the second wall portion 9b of the protective cover 9 and then bent in the upward direction as shown in FIG. 3 so as to be linked with an inside handle of a driver side door.

Figure 4:
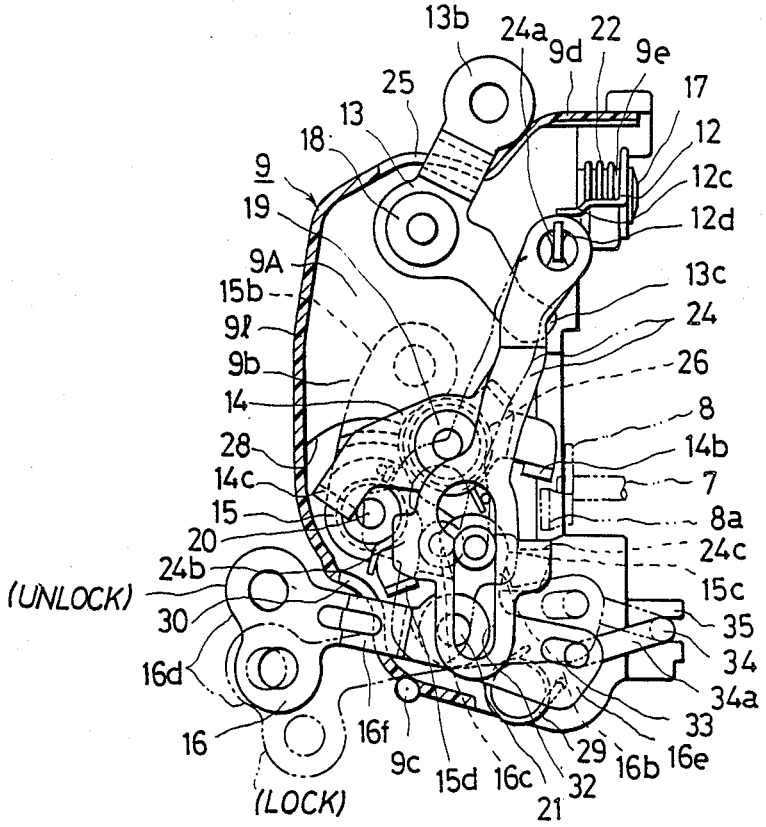
FIG. 4 is a side view of the door lock shown in FIG. 1 when seen from the line IV—IV shown in FIG. 1.

(5) Lock knob lever 16:

This lock lever 16 is selectively urged by a ring spring 29 mounted between an end of this lever and the second wall portion 9b of the protective cover 9 to an unlocked position as shown by the solid lines in FIG. 4 or to a locked position as shown by the phantom lines in FIG. 4 from a neutral position.

This lever 16 is formed with an external linkage end 16d linked to an inside lock knob, an actuation arm 16b on which an actuation pin 31 is fixed so as to be slidably engaged with a guide slot formed at the lower end portion of the lock/unlock lever 24, and an internal linkage end portion 16e in which a slot 33 is formed so as to be engaged with an inner end portion 34a of a key lever 34 supported at the lower portion of the first wall portion 9a of the protective cover 9.

The external linkage end portion 16d of this lever 16 extends toward the outside through a lead-out opening 30 formed at the lower portion of the side peripheral wall 9l of the protective cover 9. The U-shaped bent portion 16f of lever 16 is so bent as to take a long way around the side edge of the side peripheral wall 9l at the lead-out opening 30, in the same way as in the first inside lever 13.

(6) Key lever 34:

This lever 34 is pivotally supported by four support projection plates 35 formed at the lower portion of the first wall 9a of the protective cover 9, and covered by a vertical plate 1i formed at the lower portion of the side end wall portion 1A of the base plate 1 so as not to be removed from the support projection plates 35. This lever 34 is formed with an external linkage end portion 34b linked to a key lever of a door key cylinder (not shown) and the inner end portion 34a engaged with slot 33 formed at an end portion 16f of the lock knob lever 16.

(7) Lock/unlock lever 24:

This lever is formed with the upper end engage hole 24a to which the hook portion 12d of the outside lever 12 is fitted, an intermediate projection portion 24b with which the actuation projection portion 14c of the cancel lever 14 is brought into contact, and an actuation projection portion 24c located under the engaged projection 8a of the driven plate 8.

When lever 24 is positioned to an unlocked position as shown by the solid lines in FIG. 4 and further shifted upward by the outside lever 12, since this actuation projection 24c of this lever 24 moves upward the engaged projection 8a of the driven plate 8, pawl 6 is returned about pawl shaft 7 to the unlocked position.

In assembly of the door lock of the present invention, first the control mechanism composed of various levers such as the outside lever 12, the lock/unlock lever 24, the cancel lever 14, the first inside lever 13, the second inside lever 15, the lock knob lever 16, etc. are mounted on the protective cover, and thereafter the protective cover 9, the base plate 1 and the latch block 2 are assembled to obtain a complete door lock assembly. In the above assembly work, since various levers are mounted by use of many resin clips without use of any special tools or jigs, the assembly process is simplified and therefore the manufacturing cost can be reduced.

Further, when the door lock is attached to a door for an automotive vehicle, it is possible to prevent rain water or car wash water from entering the door lock along the door or door glass and therefore the mechanical element from being rusted.

In more detail, since the upper portion 1f and the side end portion 1g of the base plate 1 are covered by the upper peripheral wall 9d and the side peripheral wall 9l of the protective cover 9, there exists no space between the base plate 1 and the protective cover 9 through which water enters. That is, rain water dropped onto the surface of the upper peripheral wall 9d and the side peripheral wall 9l flows downward along the outer surface of the outer wall of the protective cover 9, without entering the inner space of the door lock. In particular, all the external linkage end portions 12b, 13b, 15b and 16b of all the levers 12, 13, 15 and 16 extend through lead-out openings 23, 25 28 and 30 all opened in the horizontal direction in such a way that the U-shaped bent portions 13d and 16f of the first inside lever 13 and the lock knob lever 16 are bent so as to take a long way around the side edge of the peripheral wall of the protective cover 9 at the lead-out openings, it is possible to prevent water on the protective cover 9 from entering the inside of the door lock through the lead-out openings. That is, water flows directly from the edges of the lead-out openings in the downward direction along the door.

In the above embodiment, the lead-out openings through which the various levers extend are formed horizontally. Without being limited thereto, however, it is possible to form these lead-out openings so as to extend in any directions except the upward direction.

The operation of the door lock will be described hereinbelow.

To open the door under the unlocked conditions, any one of the outside lever 12, the first inside lever 13 and the second inside lever 15 is actuated manually. In more detail, since the lock/unlock lever 24 is located at the unlock position as shown by the solid lines in FIG. 4, when the outside lever 12 is pushed downward, the upper end of the lock/unlock lever 24 is moved upward and therefore the engaged projection portion 24c of the lock/unlock lever 24 moves the engage projection 8a of the driven plate 8 upward to pivot the pawl 6 to an unlock position about the pawl shaft 7, so that the latch 5 is returned to the unlock position to allow the door to be opened.

When the first inside (passenger side) lever 13 is actuated by a passenger, since the external linage end portion 13b of the first inside handle 13 is pivoted counterclockwise as shown in in FIG. 2, in the same way the outer linkage end portion 13c of the first inside lever 13 moves the hook portion 12d of the outside lever 12 upward to move the lock/unlock lever 24 in the upward direction.

When the second inside lever 15 is pivoted counterclockwise in FIG. 2, since the actuation end 15c of this lever 15 directly pivots the engage projection 8a of the driven plate 8 clockwise in FIG. 2, the door will be opened.

This second inside (driver side) lever 15 has an "override" function to return the lock knob lever 16 to an unlock position.

In more detail, when the key lever 34 is pivoted clockwise in FIG. 4, since the lock knob lever 16 is pivoted to a position shown by phantom lines in FIG. 4, the lock/unlock lever 24 is shifted away from the engage projection 8*a* of the driven plate 8 into a lock condition, in which it is impossible to pivot the pawl 6 to an unlock position by the outside lever 12 or the first inside lever 13. To pivot the key lever 34 counterclockwise, a key cylinder or an inside lock knob linked to the lock knob lever 16 is used to return the lock knob lever 16 to the unlock position as shown by solid lines in FIG. 4.

When the lock knob lever 16 is set to the lock position, since the side engage surface 16*c* of this lever 16 approaches the actuation claw 15*d* of the second inside lever 15, when the second inside lever 15 is pivoted counterclockwise in FIG. 4, the actuation claw 15*d* urges the side engage surface 16*c* to return the lock knob lever 16 and the lock/unlock lever 24 to the unlock position as shown by solid lines in FIG. 4. In other words, even if the door is locked by the first inside lever (for passenger) linked to an inside lock knob, it is possible to unlock the door by actuating the second inside lever 15 (for driver) linked to an inside lock knob or handle.

After the driver gets out the car, when the driver actuates the inside lock knob (the lock knob lever 16) to set the lock/unlock lever 24 to a lock position as shown by the phantom lines in FIG. 4, the intermediate projection 24*b* of the lock/unlock lever 24 approaches the actuation projection 14*c* of the cancel lever 14. Therefore, when the door is closed without use of the outside handle (the outside lever 12), since the driven plate 8 is temporarily pivoted clockwise in FIG. 2. When the striker is engaged with the latch 5, the engage projection 8*a* of the driven plate 8 moves the driven projection 14*b* of the cancel lever 14 upward, so that the actuation projection 14*c* is brought into contact with the intermediate projection 24*b* of the lock/unlock lever 24 to forcibly pivot the lock/unlock lever 24 to the unlock position as shown by solid lines in FIG. 4. When this lock/unlock lever 24 is pivoted to the unlock position, the lock knob lever 16 is also pivoted to the unlock position as shown by solid lines in FIG. 4.

In contrast with this, when the door is closed by actuating the outside handle (the outside lever 12), since the intermediate projection 24*b* of the lock/unlock lever 24 is moved upward away from the actuation projection 14*c* of the cancel lever 14, the lock/unlock lever 24 will not be returned to unlock position by the actuation projection 14*c* of the cancel lever 14 even if the striker is engaged with the latch 5 to temporarily pivot the driven plate 8 clockwise, so that the locked condition is kept maintained.

As described above, in the waterproof door lock for an automotive vehicle according to the present invention, since (1) the door lock mechanism is arranged between the base plate and the protective cover; (2) at least the upper end portion of the base plate is covered by peripheral walls extending from the walls of the protective cover; (3) the various control levers are led out toward the outside through lead-out openings formed horizontally outward between end side surface of the base plate and the lower surface of the peripheral wall of the protective cover; and (4) some control levers are led out through the lead-out openings in such a way the U-shaped bent portions of the control levers are so bent as to take a long way around the side edges of the peripheral walls of the protective cover at the load-out openings, it is possible to effectively prevent water from coming into the door lock and therefore to prevent the control mechanism thereof from being rusted or frozen.

What is claimed is:

1. A waterproof door lock attached to a door to control a door latch locking/unlocking pawl for an automotive vehicle, comprising:

(a) a base plate member fixed to inside the door;

(b) a protective cover, attached to said base plate member, having at least one peripheral wall extending from a wall of said protective cover 9 to cover at least one upper end portion of said base plate member; and (c) a door lock mechanism, arranged between said base plate member and said protective cover, for selectively actuating the door latch locking/unlocking pawl, said door lock mechanism comprising a plurality of control levers, each led outside through a lead-out opening formed horizontally outward between an end side surface of said base plate member and a lower surface of the peripheral wall of said protective cover, at least one of said control levers being formed with a U-shaped bent portion led out through the lead-out opening by taking a long way around the end side surface of the peripheral wall of said protective cover.

* * * * *